United States Patent [19]

Kuist et al.

[11] 4,118,102

[45] Oct. 3, 1978

[54] ISOLATED PATH COUPLING SYSTEM

[75] Inventors: Charles H. Kuist, Newburyport; Vincent Squitieri, Billerica; Richard E. Seeger, Topsfield, all of Mass.

[73] Assignee: Chomerics, Inc., Woburn, Mass.

[21] Appl. No.: 564,710

[22] Filed: Apr. 3, 1975

Related U.S. Application Data

[63] Continuation-in-part of Ser. No. 479,668, Jun. 17, 1974, Pat. No. 4,065,197.

[51] Int. Cl.[2] ..... H01R 13/00

[52] U.S. Cl. ..... 339/17 F; 339/DIG. 3

[58] Field of Search ..... 339/17 F, 17 E, 18 C, 339/DIG. 3; 338/99, 100, 114

[56] References Cited

U.S. PATENT DOCUMENTS

| | | | |
|---|---|---|---|
| 2,744,981 | 5/1956 | Spears | 338/114 UX |
| 3,028,573 | 4/1962 | Stoehr | 339/18 C |
| 3,509,296 | 3/1972 | Du Rocher | 339/DIG. 3 |
| 3,648,002 | 4/1970 | Harshman | 339/DIG. 3 |
| 3,680,037 | 7/1972 | Nellis et al. | 339/18 C |
| 3,883,213 | 5/1975 | Glaister | 339/DIG. 3 X |

OTHER PUBLICATIONS

Einolf et al.; "Pressure Controlled Resistance Matrix"; IBM Tech. Disclosure Bulletin, vol. 6, #3; Aug. 1963, p. 4.

*Primary Examiner*—Joseph H. McGlynn
*Attorney, Agent, or Firm*—Sewall P. Bronstein; Donald Brown

[57] ABSTRACT

A circuit board or sheet of homogeneous material having one or more circuit elements adhering to a surface thereof, said sheet providing a low through resistance path between each circuit element and opposed and aligned contacts positioned in surface contact with the opposite side of the sheet while providing a high isolation resistance between out of alignment contacts positioned on the opposite side of the sheet and between contacts positioned on the same side of the sheet positioned an isolation distance from said circuit elements. The circuit board with a circuit pattern is shown in various applications, such as keyboard or watch.

3 Claims, 18 Drawing Figures

ISOLATED PATH COUPLING SYSTEM

This application is a continuation-in-part of application Ser. No. 479,668 filed June 17, 1974, now U.S. Pat. No. 4,065, 197.

BACKGROUND OF THE DISCLOSURE

This invention is directed to a new and improved homogeneous material circuit board or sheet having a first circuit pattern element or elements supported on one side thereof and making surface contact therethrough to contacts or other isolated circuit patterns in surface contact with the other side thereof where aligned with and opposed to portions of the first circuit pattern element or elements.

The board or sheet of this invention comprises a binder e.g., plastic, in which electrically conductive particles are homogeneously dispersed.

In the past, in order to make contact from elements on one side of a circuit board to elements on the other side of a circuit board, eyelets or other material which extended from one surface of the board to the opposite surface were provided.

The present invention does away with the requirement of such direct connections in that the board of this invention has a low through resistance between aligned and opposed contacts e.g., screen and inked or plated on contacts adhering to opposite surfaces thereof.

At the same time the sheet will permit isolated contacts positioned on the same side of the board and in contact therewith to remain isolated from each other when positioned an isolation distance apart from each other.

In this invention surface contact or touching need only be made to the sheet and compression of the volume of the board or sheet between opposing contacts to force electrically conductive particles together in the sheet is not necessary to achieve conduction or low through resistance, e.g., electrical contacts need only be screened on both sides of the sheet to effect contacting from one side of the sheet to the other side of the sheet where the circuit patterns are aligned and opposed.

The circuit board or sheet of the present invention can be termed an isolated path board in that it exhibits a low through resistance in a volume between aligned opposing surface contacts on opposite sides of the sheet and exhibits a higher isolation resistance in all volumes thereof at a distance greater than about the thickness of the sheet. Thus electrical contacts e.g., circuit pattern portions positioned apart from each other on the same side of the sheet at a distance greater than about the thickness of the sheet (an isolation distance apart) are electrically isolated from each other even though another contact on the opposite side of the sheet and aligned with respect to one of said circuit pattern portions will be electrically coupled through a low resistance portion of the board to said aligned and opposed circuit pattern portions.

In view of the foregoing mentioned properties of the sheet of this invention it is now possible to make electrical contact between a plurality of aligned contacts of first and second circuit patterns adhered to the sheet and in surface contact therewith or a plurality of elements of one circuit pattern and the contacts of an electrical device positioned merely in surface electrical contact with the opposite side of the sheet and in alignment with elements of said one circuit pattern.

BRIEF DESCRIPTION OF THE DISCLOSURE

The invention in its preferred form comprises a board, layer or sheet of material comprising a homogeneous mixture of a binder and electrically conductive particles, said board supporting and in electrical contact with a circuit pattern adhered to at least one side thereof. Upon application of a first contact to the opposite side surface of the board in alignment with a portion of the circuit pattern the through resistance between the volume of the board between the aligned circuit pattern portion and the first contact is so low, e.g., less than 1000 ohms, preferably less than 100–200 ohms and most preferably less than 1 ohm, as to be useful for electrically coupling the circuit pattern portion to the contact.

In addition, if an added second contact is also applied as above at the same time to the same material at a second point closely adjacent the first contact and out of register or alignment with the circuit pattern portion i.e., at a distance greater than the thickness of the sheet e.g., 5 times the thickness of the sheet, the resistance between the first mentioned and second mentioned contacts remains high, greater than $10^5$ ohms, preferably greater than $10^7$ ohms, and most preferably greater than $10^9$ ohms such that the first and second contacts are in effect electrically isolated from each other and the second contact is also electrically isolated from the circuit pattern portion.

The thickness of the board, layer or sheet of material is preferably between 1 mil to 100 mils with a thickness of 2 to 40 mils being preferred and a thickness of 10 to 30 mils being most preferred. If the material becomes too thick, the material is no longer economic. If the material becomes too thin, then the material is hard to handle since it does not have sufficient physical strength.

The present invention discloses the use of electrical conductive powder or particles to produce the above mentioned electrical contacting and isolating effect of the board.

As used herein the term electrically conductive powder or particles is intended to include metal powders as well as metal coated or covered particles such as glass or ceramic or other conductive or insulator material cores covered or coated with a layer of metal, or other electrically conductive particles such as titanium carbide.

The metals most desired for this invention includes the noble metals such as silver and gold or other metals such as copper and nickel or any combination thereof such as silver coated copper.

In terms of volume percent the conductive powder or particles contained in the board, layer or sheet of material should be less than 20 volume percent to about 0.05 volume percent with 9 to 18 volume percent being preferred where metal particles are used and 0.05 to 0.11 volume percent being preferred where metal is covering an insulator core. As used herein the term volume percent means volume of the sheet when considering only the binder and the electrically conductive portion of the powder or particles e.g., the metal coating the glass or the metal itself.

When coated particles are used the insulator core is to be added to the binder for the volume percent determination of the metal content. For example, if the sheet contains binder equal to 70 volume percent, and silver coated glass cores are used, wherein the amount of silver in the sheet is 0.09 volume percent and the core represents 29.91 volume percent of the total sheet, the amount of metal (silver) is obviously equal to 0.09% volume percent of the total sheet, i.e., the sum of the binder, the glass cores and the silver.

While various irregular shaped particles may be used, for the practice of this invention it is preferred that the particles be substantially spherical in shape.

In addition, the particles size in terms of its maximum dimension is preferably between 0.2 mils to 90 mils depending upon sheet thickness and it is particularly preferred that the particle size is less than the thickness of the layer or sheet of material so that the particles do not extend above or below the surfaces of the layer or sheet.

For example, with sheet thickness of 20 mils it is preferred that the particles be of a size of about 10 mils (about 250 microns). It is also highly desireable for the practice of this invention that the dispersity of particle size should be kept to a minimum with a variation of ± 20 percent or less being preferred.

The binder materials suitable for the practice of this invention include flexible insulator materials such as thermosetting plastics, thermoplastics and elastomers. As used herein the term plastic is intended to include elastomers such as rubbers.

Examples of such materials include silicone rubber, ethylene propylene polymer, Buna-N (nitrile rubber), polyurethane rubber, styrene butadiene rubber, natural rubber, neoprene rubber, polyethylene, polypropylene, vinyl chloride, and acrylics e.g., polyethylmethylacrylate.

For the practice of this invention the sheet is preferably between 1 to 100 mils in thickness and more preferably between 2 to 40 mils in thickness e.g., 6 mils.

In addition, the present invention does not preclude the use of fillers, plasticizers, catalysts, accelerators, pigments, smoothing agents commonly utilized in conductive plastics or elastomers such as silica (useful for its mechanical binding properties) as long as these materials do not severely affect the desireable properties of the connector.

It should be understood that the connector of this invention need not be in sheet form and can take many other physical shapes e.g., wedge shaped, step shaped or other molded forms as long as it operates in the manner disclosed. For example, it may contain locating ridges, protrusions, etc., which make it particularly useful for a particular function. In addition, it may vary in thickness over its length or other dimensions when desired.

The circuit patterns of this invention may comprise conductive coatings, inks or metal patterns (e.g., lines) which are directly adhered to the board surface or indirectly through electrically conductive adhesive.

The conductive inks or coatings may comprise plastics filled with electrically conductive particles. The circuit patterns may be screened on, printed or applied in any other conventional manner.

The invention disclosed herein is shown in the preferred embodiments of the drawings in a watch, calculator and for coupling electrical devices together.

DETAILED DESCRIPTION OF THE DISCLOSURE

Figure 1:
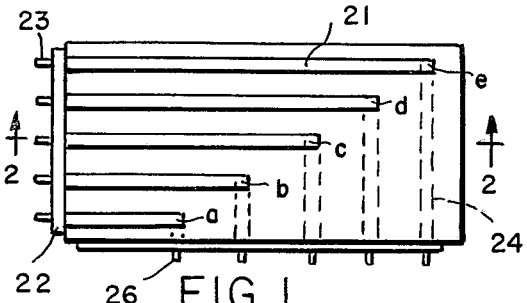
FIG. 1 is a top plan view of a sheet or board of this invention used as a coupler and having circuit patterns adhered to both sides thereof.
Figure 3:
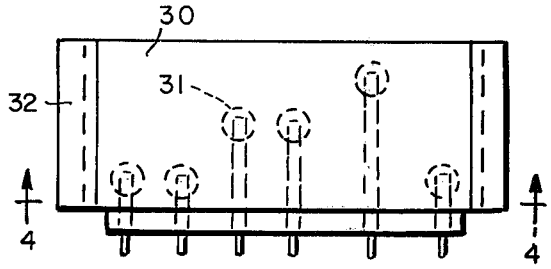
FIG. 3 is a top plan view showing the coupling of an electrical device to a board of this invention supporting a plurality of circuit patterns.
Figure 2:
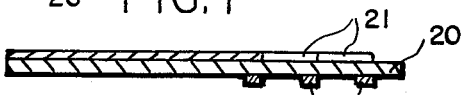
FIG. 2 is a sectional view taken along line 2—2 in FIG. 1.
Figure 4:
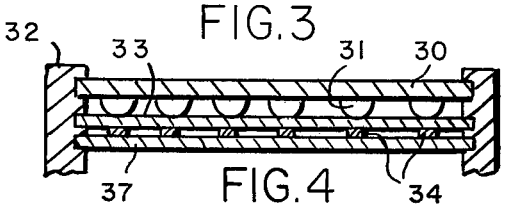
FIG. 4 is a sectional view taken along line 4—4 in FIG. 3.
Figure 7:
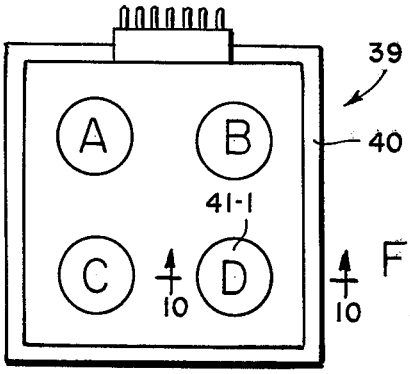
FIG. 7 is a top view of a keyboard using the circuit board of the invention.
Figure 5:
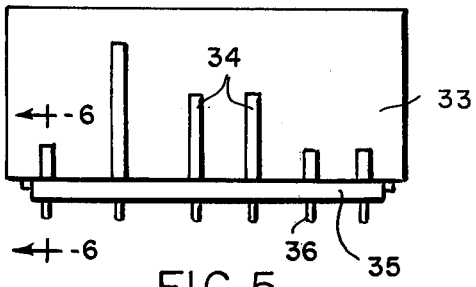
FIG. 5 is a bottom view of the board supporting the plurality of circuit elements.
Figure 8:
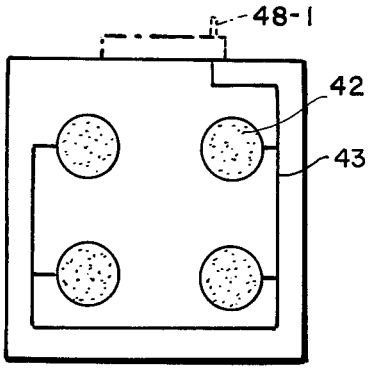
FIG. 8 is a bottom view of the keys of the keyboard supporting a circuit pattern adhered thereto and forming contacts.
Figure 9:
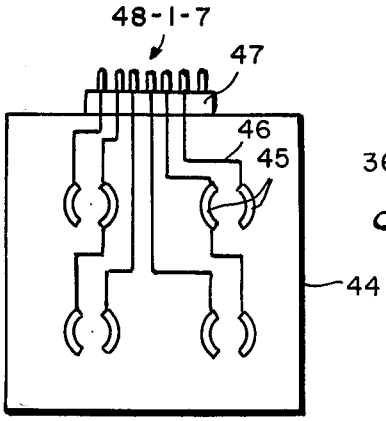
FIG. 9 is a bottom view of the board supporting a circuit pattern used to generate a code.

FIGS. 1 and 2 illustrate the board or sheet of this invention which has applied to it two circuit patterns. One circuit pattern 21 supported on one side of the sheet comprises five lines or paths of conductive ink spaced apart from each a distance of about two times the thickness of the sheet.

A second circuit pattern 24 is shown supported on the opposite side of the sheet in the same manner as the first circuit pattern.

As may be observed, portions at points *a–e* of each circuit pattern are opposed to and in alignment with each other. Thus, there is provided a through path at points *a–e* between the circuit patterns 21 and 24 where they are aligned.

On the other hand since each of the circuit pattern lines are positioned a distance greater than about the thickness of the sheet apart, they do not short out and are only coupled together where they are aligned with each other.

Extended coupling of the circuit pattern 21 is accomplished via connector 22 through pins 23 and external coupling of circuit pattern 24 is accomplished via connector 25 through pins 26.

Thus, the structure of FIGS. 1 and 2 provide a means for coupling one electrical device to another through the use of a board having circuit patterns adhered to and supported on the opposite surfaces thereof. Current will flow through each of the elements of the circuit pattern 21 through the volume of the board and into the elements of circuit pattern 24 where the elements of circuit pattern 24 are aligned on opposite board surfaces with the elements or portions of circuit pattern 21 (parts *a–e*).

No pressure need be applied to achieve a low through resistance between the aligned elements of the circuit patterns and the diagonal or adjacent positioned elements of each circuit pattern will remain isolated from each other. Normally the isolation resistance between elements of each circuit pattern will be greater than about $10^5$ ohms. This element 21*a* will be isolated from adjacent elements 21*b* to *e* as well as from elements 24*b* to *e* and elements 21*a* and 24*a* will be coupled together where they cross over.

FIGS. 3 to 6 disclose the use of the circuit board of this invention coupling the contacts 31 of an electrical device 30 to electrically conductive circuit pattern elements 34 adhered to the board 33. The elements 34 are connected to pins 36 supported in a holder 35. The assembly is held together by supports 33 and an insulator plastic base member 37 supports the circuit board as shown.

Figure 6:
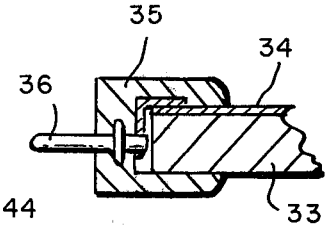
FIG. 6 is a sectional view taken along line 6—6 in FIG. 5.
Figure 10:
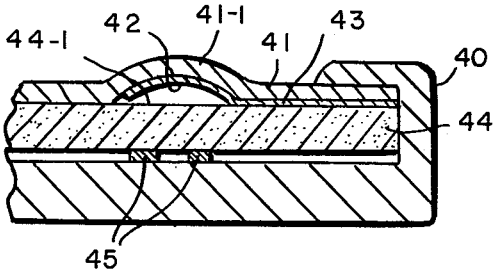
FIG. 10 is a sectional view taken along line 9—9 of FIG. 6 showing the key when undepressed.

In FIGS. 7–11 there is shown a keyboard utilizing the invention. The keyboard is shown at 39 and comprises a frame 40 supporting a top sheet 41 of resilient and flexible plastic e.g., Mylar in which snappable protrusions such as in U.S. Pat. No. 3,860,771. The underside of the top sheet 41 is provided with an electrically conductive plastic coating 42 coupled together via circuit lines 43 (as in U.S. Pat. No. 3,860,771) coupled to pin 48-1 of pins 48-1 to 48-7. The pins 48-1 to 48-7 are supported in holder 47 of the same type as shown in FIG. 6.

Figure 11:
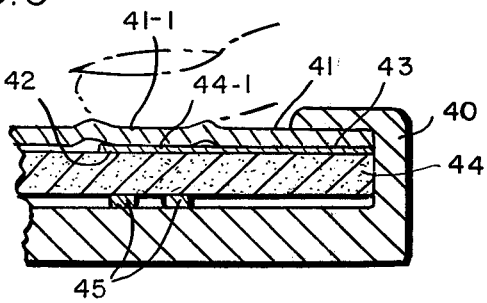
FIG. 11 is a view similar to FIG. 10 showing the key when depressed.
Figure 12:
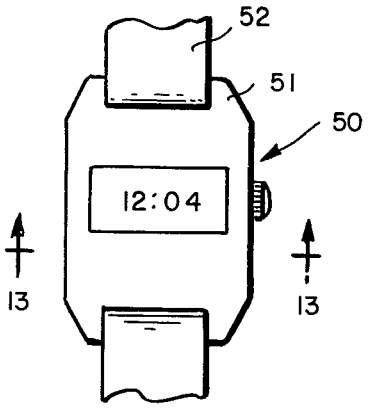
FIG. 12 is a top plan view of a digital watch utilizing the circuit board of this invention.

The circuit board of this invention is shown at 44 and has on the bottom thereof contact segments 45 which are coupled together or to pins 48-1 to 48-7 by circuit pattern elements 46. The circuit pattern element and the segments may be screened on and are e.g., of a thickness of about 2 mils and the elements may be of a width of about 80 mils with the segments being about 150 mils to assure good connection with the depressible coating 42 when the finger depresses the protrusion 41-1 as shown in FIG. 11 against the top of the sheet in alignment and in opposition to the segments 45.

When the coating 42 makes surface contact between the top surface 44-1 of the sheet, a low through resistance exists between segments 45 and this conduction may take place between common pin 48-1 and the other pins 48-2 to 48-7 depending upon which protrusion 41-1 is depressed.

Reference should now be had to FIGS. 12–18 which discloses yet another structure for use in a watch of the digital type to coupled components such as integrated circuit chips, batteries to a display such as a liquid crystal display.

In this figure the watch is shown at 50 and is coupled to a strap 52. The watch includes a top casing 51, e.g., plastic which snaps to a bottom casing 53, e.g., plastic in a conventional manner.

A liquid crystal display is shown at 55 which includes a plurality of conductive pads 55-1 to 55-8 on both sides thereof as in U.S. Pat. No. 3,861,135.

The bottom casing 53 supports two integrated circuit chips 57 and 58 (see FIG. 17) which are to be coupled to the liquid crystal display pads 55-1 to 55-8. The integrated circuit chips include electrically conductive pads 57-1 and 58-1 along the sides thereof. The battery is shown at 59 and includes a casing contact element 59-1 which provides one terminal and a top terminal 59-2. The battery terminals 59-1 and 59-2 are coupled to chips 58 and 59 as shown through end pads 57-2 and 58-2 (see FIG. 16). The chips 57, 58 and battery 59 are supported in wells 53-1 and are most preferably urged upwardly by resilient biasing means, e.g., springs 53-2 to insure good contact in the event of tolerance variation in the chips or battery. A resilient rubber pad can be used in place of the spring.

The display 55, and integrated circuit chips (IC) 57 and 58 are coupled together through circuit elements 56-1 to 8 supported on the bottom surface of the board 56 of this invention disclosure. The elements may be screened on as previously described.

Figure 14:
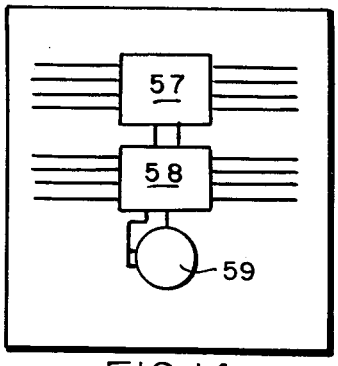
FIG. 14 is a bottom view illustrating the circuit pattern elements supported by the board.
Figure 15:
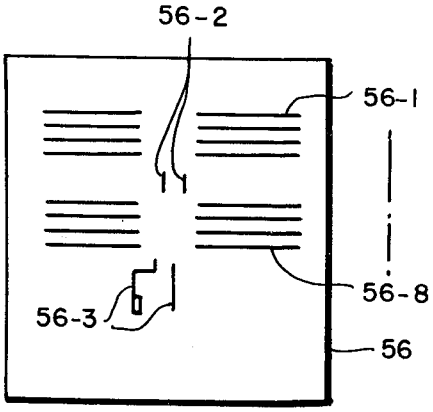
FIG. 15 is a bottom view illustrating components of the watch positioned on the board and coupled to the circuit pattern elements.
Figure 16:
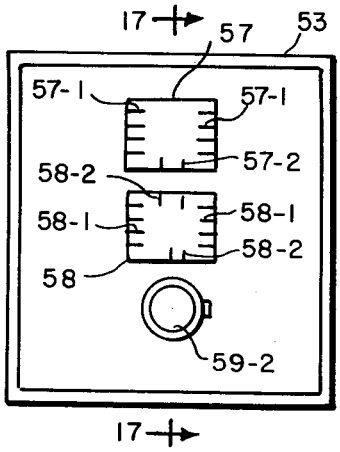
FIG. 16 shows in a top plan view the bottom of the watch casing supporting the components.
Figure 17:
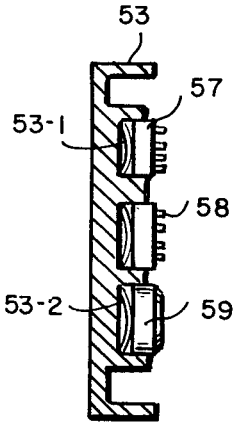
FIG. 17 is a sectional view taken along line 17—17 of FIG. 16.
Figure 18:
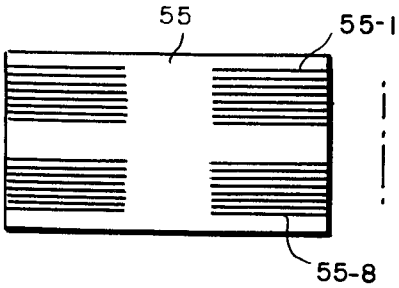
FIG. 18 illustrates in a bottom view the display for the watch.

FIG. 14 discloses the IC's 57 and 58 and the battery 59 on top of the bottom board 56 with the pads 57-1, 57-2, 58-1, 58-2, terminals 59-1 and 59-2 making contact with circuit elements 56-1 to 56-8 (on both sides of the sheet) and circuit elements 56-2 to 56-3. In this manner direct contact is made by the IC's and the battery 59 supplies power to the IC's.

Figure 13:
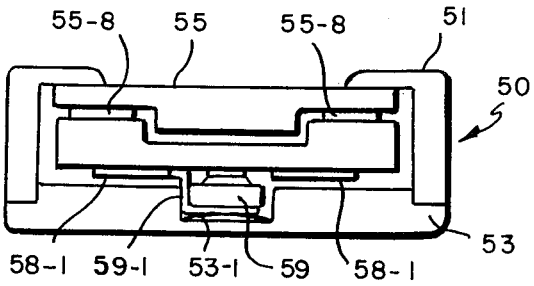
FIG. 13 is a sectional view taken along line 13—13 in FIG. 12.

Contact is made to the contact pads 55-1 to 55-8 on both sides of the display 55 through the board 56 where there is alignment between elements 56-1 to 56-8 and 55-1 to 55-8, where they are aligned as in FIG. 13. It should be understood that elements 55-1 to 55-8 align themselves with elements 56-1 to 56-8 on the circuit board 56.

In this manner connection is made between the IC's and the display through circuit pattern elements supported by and in surface contact with the board 56 and the pads 55-1 to 55-8 in surface contact with the opposite side of the board 56 as shown in FIG. 13.

Reference should now be had to examples which illustrate representative circuit board composition, screening compositions, and a circuit pattern screen on a circuit board.

EXAMPLE I

A circuit board or sheet is prepared from:

| | |
|---|---|
| Dow Corning 440 Silicone Gum Rubber | 79.83 vol. % |
| Cabosil MS 7 fumed Silica | 3.55 vol. % |
| Chemalloy U.B. 20/325 grade | 15.70 vol. % |
| Nickel Powder (screened through 60 mesh, caught on 100 mesh) Chemalloy Co. Bryn Mawr, Pa. | |
| Varox Peroxide catalyst (50% active) | 0.92 vol. % |

The rubber gum is banded together at room temperature on a rubber roll mill until a small bank is produced between the mill rolls. At this time the Varox is added to the Silicone Gum before it proceeds through the rolls to force the Varox into the gum. In the same manner the silica is added first and then the nickel is added. The gum with the added materials is periodically cut as it comes out of the rolls and is re-fed through the rolls until a homogeneous mixture is obtained. Fifteen passes have been found to be sufficient.

The rolls of the mill are spaced apart to provide a sheet of about 25 mil thickness. The sheet is then placed in a compression mold at 4000 psi pressure for 20 minutes at 325° F to cure to provide a 20 mil sheet. The sheet is then post baked for 3 hours at 400° F to complete the cure.

The sheet thus obtained has a thickness of about 20 mils.

EXAMPLE II

The procedure of EXAMPLE I was followed except that Nickel Powder was screened through 100 mesh and caught on 325 mesh. The sheet prepared was 20 mils thick.

EXAMPLE III

The procedure of EXAMPLE I was followed except that the following ingredients were used to form a 10 mils thick sheet under compression after sheeting to 15 mils.

| | |
|---|---|
| Dow Corning 440 Silicone Gum Rubber | 80.03 vol. % |
| Cabosil MS 7 fumed Silica | 3.56 vol. % |
| Varox Peroxide catalyst (50% active) | 0.92 vol. % |
| Silver Plated Copper Powder as in U.S. Pat. No. 3,202,488 (7.66 vol. % AG) screened through 200 mesh | 15.49 vol. % |

EXAMPLE IV

Using the mixing procedure of EXAMPLE I, except that the rolls are heated to between 270° F to 300° F a 15 mils thick sheet was prepared in a compression mold at 400 psi for 3 minutes at 250° F and then cooling same to 130° F after sheeting to 20 mils with the following ingredients:

| | |
|---|---|
| Alathon 14 low density Polyethylene (Dupont) | 47.98 vol. % |
| Vistanex L 80 polyisobutylene Enjay Chemical Co. | 32.32 vol. % |
| Chemalloy Nickel of EXAMPLE I | 19.70 vol. % |

EXAMPLE V

Following the procedure of EXAMPLE I a 20 mils thick sheet was prepared with the following ingredients:

| | |
|---|---|
| Dow Corning 440 Silicone Gum Rubber | 71.27 vol. % |
| Cabosil MS 7 fumed Silica | 3.17 vol. % |
| Verox Peroxide catalyst (50% active) | 0.82 vol. % |
| Silver Plated Glass Powder No. 24295 | 24.65 vol. % glass |
| (Potters Brothers, Carlstadt, N.J.) | 0.09 vol. % AG |

EXAMPLE VI

The EXAMPLE I procedure and ingredients was followed except that the volume percent of Nickel used was 18.74%.

EXAMPLE VII

The EXAMPLE V procedure and ingredients were followed except that the volume percent of the glass was 14.69% and the volume percent of Silver was 0.5%.

EXAMPLE VIII

| Electrically conductive Screening Ink | Parts By Weight % |
|---|---|
| General Electric - Silicone RTV 615A | 3.470 |
| General Electric - Silicone RTV 615B | .340 |
| General Electric - Silicone RTV 815 | 12.850 |
| Handy & Harmon Silver Powder P-135 | 78.130 |
| Propylene Glycol | 5.210 |
| | 100 % |

The ingredients were mixed together in a conventional manner for a liquid paste like substance which is now suitable for screening on the boards or sheet of Examples I to VII.

EXAMPLE IX

Electrically conductive Screening Ink

A polymeric mixture is prepared from 20 parts by weight of General Electric SR-585 adhesive, 80 parts by weight silver plated copper powder (granular) prepared in accordance with EXAMPLE I of U.S. Pat. No. 3,202,488 (average particle size 2–3 mils) and 30 parts of toluene.

EXAMPLE X

Screened on Circuit Pattern

The Ink of Example VIII was screened on the sheet of EXAMPLE II in a conventional manner using a mask and a brush to form the overlapping circuit pattern 21 and 24 shown in FIGS. 1 and 2.

The lines on elements 21*a–e* and 24*a–e* are of a width of 80 mils and are of a thickness of about 2 mils and the lines are spaced apart on the same surface a distance of about 40 mils.

Other circuit pattern compositions suitable for application to the circuit boards may be prepared in accordance with the examples of U.S. Pat. No. 3,576,387.

We claim:

1. A coupling system comprising a sheet of plastic material having top and bottom surfaces and having electrically conductive particles homogeneously dispersed therethrough, said sheet having means for providing at least when uncompressed a low electrical through resistance between opposite aligned points on said top and bottom surfaces and a plurality of spaced apart electrically conductive material elements supported by and adhered to and in surface electrical contact with the same surface of said sheet, said conductive elements being spaced apart on said surface of said sheet at least a distance apart equal to about the thickness of the sheet so that they are electrically isolated from each other by an isolation resistance greater than about 1000 ohms and in which the volume percent of conductive particles is between about 20 volume percent to 0.05 volume percent.

2. A coupling system comprising a sheet of plastic material having top and bottom surfaces and having electrically conductive particles homogeneously dispersed therethrough, said sheet having means for providing at least when uncompressed a low electrical through resistance between opposite aligned points on said top and bottom surfaces and a plurality of spaced apart electrically conductive material elements supported by and adhered to and in surface electrical contact with the same surface of said sheet, said conductive elements being spaced apart on said surface of said sheet at least a distance apart equal to about the thickness of the sheet so that they are electrically isolated from each other by an isolation resistance greater than about 1000 ohms and in which the particles are metal and are between 9 to 18 volume percent.

3. A coupling system comprising a sheet of plastic material having top and bottom surfaces and having electrically conductive particles homogeneously dispersed therethrough, said sheet having means for providing at least when uncompressed a low electrical through resistance between opposite aligned points on said top and bottom surfaces and a plurality of spaced apart electrically conductive material elements supported by and adhered to and in surface electrical contact with the same surface of said sheet, said conductive elements being spaced apart on said surface of said sheet at least a distance apart equal to about the thickness of the sheet so that they are electrically isolated from each other by an isolation resistance greater than about 1000 ohms and in which the particles comprise metal covering an insulator core and the metal comprises 0.05 to 0.11 volume percent.

* * * * *